United States Patent [19]

Harrison

[11] Patent Number: 4,550,297

[45] Date of Patent: Oct. 29, 1985

[54] RF COMPONENT HAVING SELF-BIASING TO ELIMINATE MULTIPACTING

[75] Inventor: William H. Harrison, Los Angeles, Calif.

[73] Assignee: Frequency West Inc., Santa Clara, Calif.

[21] Appl. No.: 479,717

[22] Filed: Mar. 28, 1983

[51] Int. Cl.[4] ..... H01P 1/00

[52] U.S. Cl. ..... 333/99 MP; 333/222; 315/39; 313/106

[58] Field of Search ..... 333/99 MP, 13, 227, 333/219, 218, 222, 17 L, 262; 315/39, 39.51, 39.57; 313/106, 103, 104; 331/90, 89, 101

[56] References Cited

U.S. PATENT DOCUMENTS 3,457,490 7/1969 Keenan ..... 333/99 MP 4,105,951 8/1978 Pickering et al. ..... 333/13 X

*Primary Examiner*—Eugene R. LaRoche

*Assistant Examiner*—Benny T. Lee

*Attorney, Agent, or Firm*—Spensley Horn Jubas & Lubitz

[57] ABSTRACT

In an RF/microwave component such as a resonator, multipacting is eliminated in accordance with the present invention by rectifying a portion of the RF signal present within the component to derive a dc potential. This dc potential is used to bias the component so as to the prevent polarity reversal across the component electrodes, thereby to eliminate multipacting without the use of an external bias supply.

6 Claims, 4 Drawing Figures

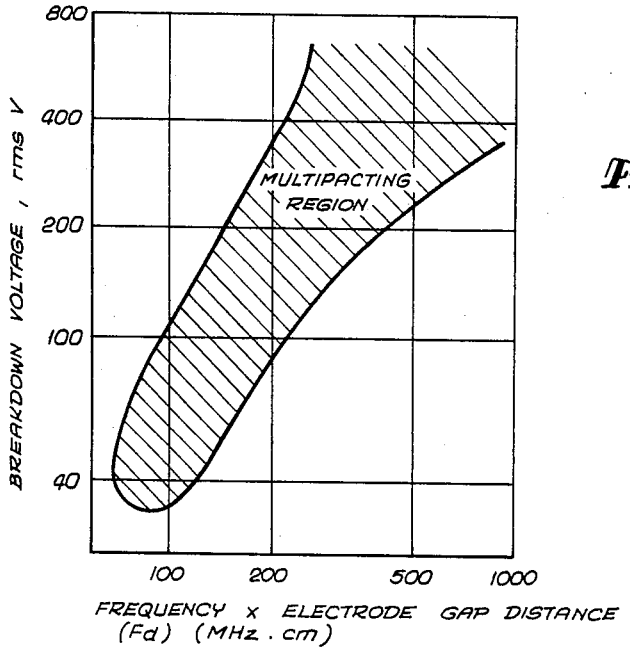
Fig. 1
Fig. 2
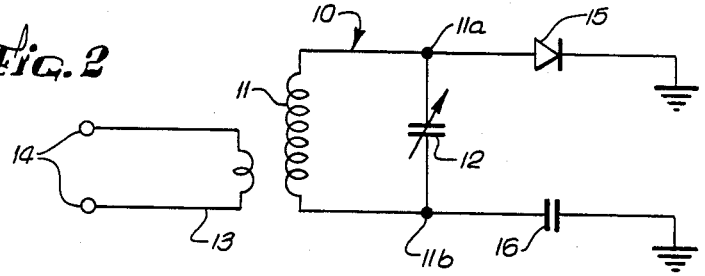
Fig. 3
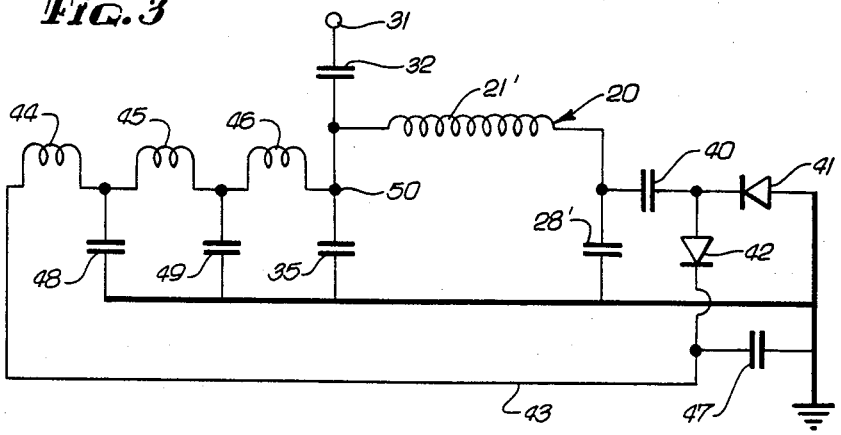

RF COMPONENT HAVING SELF-BIASING TO ELIMINATE MULTIPACTING

BACKGROUND OF THE INVENTION

1. Field of the Invention

The present invention relates to means for eliminating multipacting in an RF/microwave component, and particularly to such a component wherein the RF potential is rectified to derive a dc potential which self-biases the component so as to prevent polarity reversal across the component electrodes, thereby to eliminate multipacting.

2. Description of the Prior Art

The multipacting mechanism of RF voltage breakdown in RF/microwave components is of considerable importance when such components are used in very high vacuum environments such as those encountered in space. A good description of the multi-pacting mechanism is set forth in the Jet Propulsion Laboratory Technical Report 32-1500 entitled "Final Report on RF Voltage Breakdown in Coaxial Transmission Lines" by R. Woo.

At very low pressures, such as those encountered in space, the mean free path of electrons may be longer than the separation distance d between electrodes of the microwave component. Under these conditions, electrons can readily travel between the component electrodes without undergoing collisions with the gas molecules. If an electron should collide with one of the electrodes, secondary electrons may be released. If this occurs as the RF electric field within the component passes through zero, the reverse electric field will accelerate the electrons back across the gap between the component electrodes. If the transit time of the electrons across the gap is one-half cycle of the RF field, the secondary electrons formed by the initial collision become primary electrons when they strike the other component electrode and cause the release therefrom of additional secondary electrons. These in turn are accelerated toward the first electrode by the now reversed polarity of the RF electric field.

This operation repeats itself each half-cycle of the RF field, resulting in the rapid build-up of large electron densities within the gap between the microwave component electrodes. Rf voltage breakdown results. At the onset of such multipacting breakdown, as much as seventy-five percent of the RF energy introduced into the component may be lost. Should such multipacting breakdown continue, typically twenty percent or more of the introduced RF energy will be dissipated. The "lost" energy is expended in the undesired secondary electron production, and often results in excessive heating of the microwave component electrode. In extreme cases, the component may become so hot as to glow.

Woo (Op.Cit.) and others have found that the RF potential or breakdown voltage at which multipacting occurs may be very low. Indeed, they have found that this breakdown voltage is a function of the product F·d of the frequency F of operation of the component times the gap spacing d between the component electrodes. FIG. 1 shows a typical graph of this relationship (and is adapted from the Woo paper cited above). By way of example, for an RF/microwave component operating at 100 MHz and an electrode gap spacing of 1 cm (so as to have an F·d product of 100), multipacting breakdown will occur with RF potentials as low as forty volts. Indeed, as shown by the broken line in FIG. 1, multipacting breakdown will occur for this configuration with RF potentials between about forty volts and one hundred volts.

Reducing or increasing the electrode gap spacing d so that the product F·d lies outside the multi-pacting region (FIG. 1) is one approach to eliminating the multipacting problem. However, such dimension parameters (i.e., reduction or increase in the electrode gap spacing) may be impractical or undesirable in the particular RF/microwave component design. Therefore this approach to elimination of the multipacting problem may be disadvantageous for a particular component.

A more generally acceptable technique for elimination of multipacting is to superimpose a dc bias across the component electrodes. If this bias is sufficiently large, then the RF electric field potential, when superimposed on the dc bias, will always be of the same polarity. For example, if the RF electric field potential varies between +40 V and −40 V, but a dc bias of +50 V is applied across the component electrodes, the net electric field across the gap will vary between +10 V and +90 V.

The effect of this dc bias is to completely eliminate the multipacting. Since the polarity of the electric field between the component electrodes does not change each cycle of the RF field, then the condition necessary for accelerating the secondary emission electrons across the gap is missing. In other words, since the field polarity does not reverse, there will be no acceleration of electrons in alternating directions across the electrode gap on alternate half-cycles of the RF field. The basic condition necessary for multipacting is no longer present.

In the past, such dc biasing has been provided by a power supply external to the microwave components itself. Although effective in eliminating multipacting, the requirement for providing this external dc biasing power supply has added significantly to the cost, size and weight of the microwave assembly. It is this shortcoming of the prior art which is overcome by the present invention, an objective of which is to provide an RF/microwave component which is self-biasing. A concomitant objective is to provide a means for self-biasing an RF/microwave component so as to obviate the need for a separate dc biasing power supply to eliminate multipacting.

A further objective is to provide an RF/microwave component which includes means for deriving a dc bias directly from the RF potential developed across the component electrodes, thereby eliminating the need for an external dc biasing power supply.

SUMMARY OF THE INVENTION

These and other objectives are achieved by providing a self-biasing RF/microwave component. The component includes self-contained rectifier means rectifying the RF potential developed across the component electrodes so as to derive therefrom a dc potential. The component further includes means for applying this derived dc potential across the component electrodes so as to prevent the occurrence of polarity reversal therebetween. As a result, multipacting is eliminated without the need of an external dc bias power supply.

In typical embodiments of the present invention, a diode rectifier or voltage doubler circuit is situated within or contiguous to the RF/microwave component and is coupled to the RF voltage source. The rectifier or doubler operates as in a typical power supply, with the exception that the RF voltage source is "floating" with respect to ground. The dc output of the rectifier circuit is applied across the electrodes of the RF/microwave component, advantageously with one side of such derived dc output being grounded.

In a typical application, an RF/microwave resonator or resonant filter is provided with a self-contained voltage doubler circuit. The common node of the pair of diodes in the doubler circuit is capacitively coupled to the RF/microwave resonator. This may be achieved e.g., by providing a rigid element between the anode of one diode and the cathode of the other diode, and situating this interconnecting element in capacitive coupling proximity to one of the microwave component electrodes.

The RF field potential which is capacitively coupled via this interconnecting element is rectified and doubled by the pair of diodes. The resultant dc potential is applied across the component electrodes. This supplies sufficient dc bias so as to substantially eliminate polarity reversal of the RF electric field across the electrodes, thereby inhibiting multipacting.

BRIEF DESCRIPTION OF THE DRAWINGS

A detailed description of the invention will be made with reference to the accompanying drawings wherein like numerals designate corresponding parts in the several figures.

FIG. 1 is a graph of breakdown voltage as a function of the product of frequency times the electrode gap distance for a microwave component, and illustrates the multipacting region.

FIGS. 2 and 3 are equivalent electrical circuits corresponding to self-biasing RF/microwave components in accordance with the present invention, and employing respectively a halfwave diode rectifier and a voltage doubler circuit.

DESCRIPTION OF THE PREFERRED EMBODIMENTS

Figure 4:
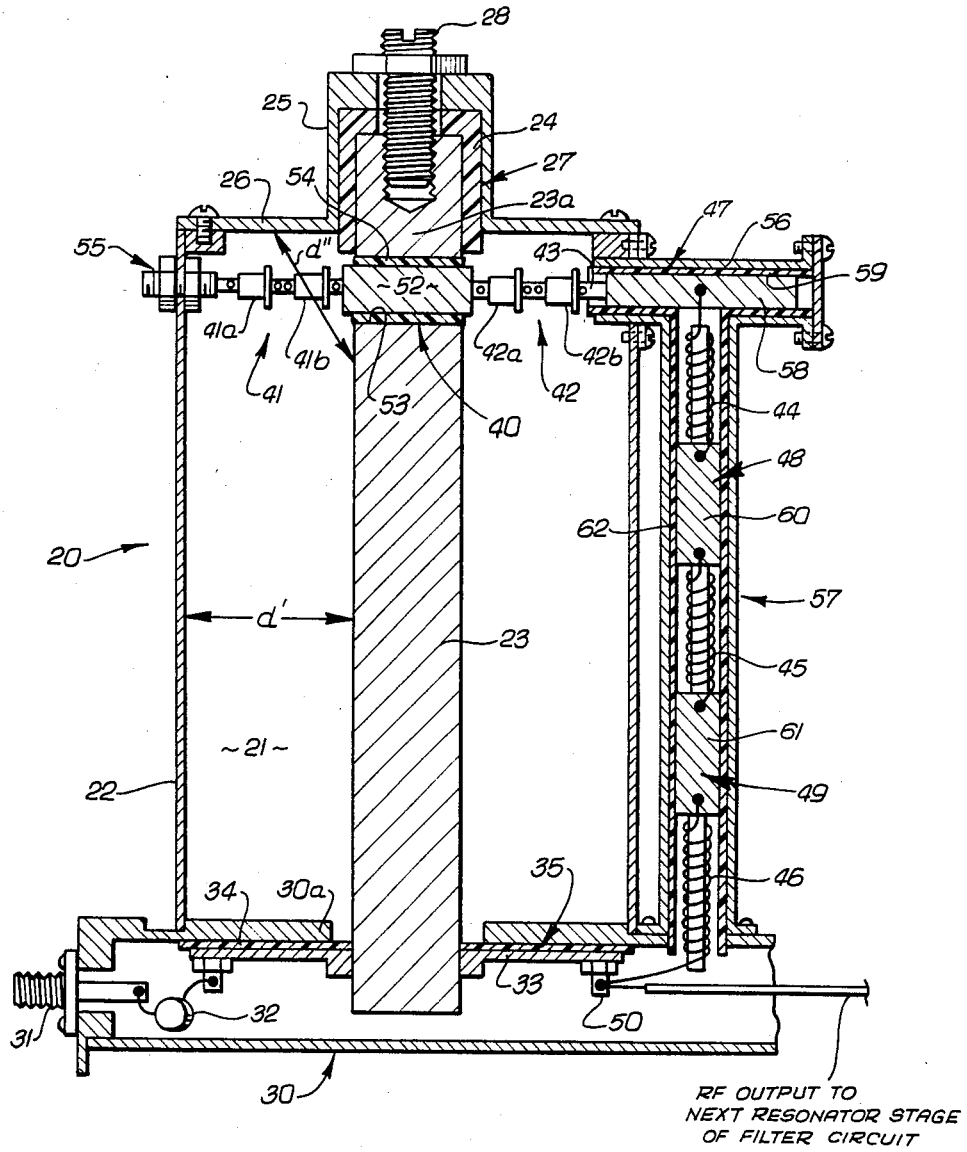
FIG. 4 is a cross-sectional view of a self-biasing RF/microwave resonator in accordance with the present invention, showing certain details of the voltage doubler components used to rectify the RF field voltage present within the resonator, thereby to derive the dc bias which is applied across the resonator electrodes so as to eliminate multipacting.

The following detailed description is of the best presently contemplated modes of carrying out the invention This description is not to be taken in a limiting sense, but is made merely for the purpose of illustration the general principles of the invention since the scope of the invention best is defined by the appended claims.

Operational characteristics attributed to forms of the invention first described also shall be attributed to forms later described, unless such characteristics obviously are inapplicable or unless specific exception is made.

FIG. 2 shows an equivalent electrical circuit correspondinq to a self-biasing RF/microwave component in accordance with the present invention. By way of example, the tuned circuit 10 consisting of an inductor 11 and a capacitor 12 may represent an RF/microwave resonator having an electrode gap distance d and operating at a frequency F such that the product F·d lies within the multipacting region (FIG. 1). The coupling coil 13 represents an input means for driving the resonator 10 with an RF signal applied at the terminals 14. Under such driven conditions, multipacting could occur if the pressure within the RF/microwave resonator were sufficiently low. The self-biasing technique of the present invention prevents such multipacting.

In accordance with the invention, the RF voltage developed within the resonator, and represented by the voltage across the inductor 11 (FIG. 2) is rectified by a diode 15 connected to one node 11*a* of the inductor 11. An RF bypass capacitor 16 connects the other node 11*b* to ground.

The RF signal present in the resonator 10 is rectified by the diode 15. As a result, a dc bias appears across the resonator 10, between the node 11*a* and ground. This dc bias maintains the node 11*a* at a fixed polarity (herein positive with respect to ground) despite the constantly changing polarity of the RF signal within the resonator 10. As a result of this fixed polarity at the node 11*a*, multipacting cannot occur. No external source is required for the bias voltage at the node 11*a*. Rather, in accordance with the present invention such bias is obtained directly by rectification of the RF signal present in the resonator 10.

FIG. 3 shows an equivalent electrical circuit corresponding to the self-biasing RF/microwave resonator 20 of FIG. 4. By way of example, the resonator 20 may be part of an RF/microwave filter having two or more like resonators connected in tandem, and operating for example, at 250 MHz.

The resonator 20 (FIG. 4) includes a resonant cavity 21 having a cylindrical, electrically conductive outer wall 22 which is grounded, and which forms one electrode of the resonator 20. The other electrode is a center conductor 23 comprising e.g., a metal rod coaxially situated within the cavity 21. An insulating sleeve 24 retains the upper end 23*a* of the center conductor 23 within a conductive "top hat" 25 that projects upwardly from an annular plate 26 which forms the top of the resonator 20. The conductor end 23*a*, the insulator 24 and the top hat 25 form a capacitor 27 which can be adjusted by a tuning screw 28 to vary the resonant frequency of the resonator 20. All of this is conventional.

Also conventional is the cavity structure 30 (FIG. 4) which supports the resonator 20. An RF signal is supplied to the resonator 20 via a coaxial connector 31, a blocking capacitor 32 and an annular plate 33 which is electrically and mechanically connected to the center conductor 23. A planar insulator 34 separates the plate 33 from a portion 30*a* of the cavity 30 which forms the bottom of the resonant cavity 21. The plate 33, the insulator 34, and the cavity section 30*a* together comprise a capacitor 35 of relatively high value.

In the equivalent circuit of FIG. 3, the tuned circuit consisting of the inductor 21' and the capacitor 28' generally represent the resonator 20. The capacitor 32 introduces RF from the terminal 31 into such tuned circuit, with the current in the tuned circuit being carried by the relatively large capacitor 35.

When operated at sufficiently low pressure, multipacting could occur within the resonator 20, depending on the frequency of operation. The principal electrode gap distance corresponds to the spacing d' between the inner and outer electrodes. Thus multipacting could occur when operating at frequencies F such that the product F·d' lies within the multipacting region illustrated in FIG. 1.

However, multipacting is not restricted only to those parameters. Note that multipacting could occur between an upper portion of the center conductor 23 and the resonator top 26 where there is a somewhat closer spacing d″. Since the product F·d″ in such instance is smaller, multipacting can occur at even lower breakdown voltages then might be required to cause multipacting between the outer cylinder 22 and the center conductor 23.

Such multipacting, however, is eliminated by the self-biasing provided by the present invention. As illustrated in the equivalent circuit of FIG. 3, RF voltage from the resonator 20 is coupled via a capacitor 40 to a voltage doubler consisting of the rectifiers 41 and 42. The resultant dc bias, obtained on a line 43, is coupled back to the resonator 20 via a set of RF filter chokes 44, 45, 46 and associated RF bypass capacitors 47, 48 and 49, and via the terminal 50. This dc voltage effectively biases the resonator 20 so as to maintain each of the electrodes 22 and 23 at a fixed polarity, thereby to eliminate multipacting.

In the embodiment of FIG. 4, the RF coupling capacitor 40 consists of a rod-shaped conductive electrode 52 situated within a bore 53 which extends transversely through the center electrode 23 near its upper end. A Teflon or other insulating sleeve 54 separates the capacitor electrode 52 from the resonator electrode 23.

In addition to functioning as one element of the capacitor 40, the electrode 52 also acts as a physical support for the diode assemblies comprising the rectifiers 41 and 42. Each of these comprises a pair of series connected diodes 41*a*, 41*b* and 42*a*, 42*b* respectively. In each case, a pair of series connected diodes is used so as to increase the peak voltage which can be handled. However, this is not necessary, and each of the rectifiers 41 and 42 may comprise a single diode.

The rectifier 41 is supported at its other end by an appropriate electrically conductive fitting 55 attached to the resonator outer wall 22. This arrangement also provides a dc ground path for the rectifier 41 output.

The other end of the rectifier 42 is supported by a structure which forms the RF bypass capacitor 47. It comprises an electrically conductive tubular member 56 projecting radially outwardly from the resonator outer wall 22, and is supported by another conductive tubular member 57 that extends downwardly to the cavity 30. The cylinder 56 forms one element of the capacitor 47. The other element is a conductive rod 58 which extends from an end of the rectifier 42 and is separated from the cylinder 56 by an insulating sleeve 59.

The RF chokes 44, 45, 46 are housed within the tubular member 57, and that member serves as the grounded element of the bypass capacitors 48 and 49. The other element of each of these capacitors is a respective conductive rod 60, 61 situated within and separated from the cylinder 57 by an insulating sleeve 62.

As RF energy is introduced into the resonator 20 via the terminal 31 and the capacitor 32, RF present in the resonator is coupled to the voltage doubler rectifiers 41 and 42 via the capacitor 40. The resultant rectified dc voltage, which appears between the node 43 and ground, is applied across the resonator 20 electrodes. The RF chokes 44, 45, 46 and their associated RF bypass capacitors act as an RF filter to prevent any residual RF present at the node 43 from being fed back to the resonator center conductor 23. The resultant dc bias across the resonator electrodes 22 and 23 is sufficient to prevent a polarity reversal at these electrodes, thereby to eliminate multipacting. No external bias supply is needed, since the dc bias is derived by rectifying RF energy present within the resonator 20. The rectifier RF voltage source "floats".

Although a resonator has been shown as an example, the invention is not so limited. Indeed, multipacting can occur in any type of RF structure, even e.g. in a coaxial cable, if the pressure is sufficiently low, and if the product F·d falls within the multipacting region. The present invention can be applied to any such RF structure or component, by providing an appropriate rectifier means for rectifying the RF present within the component, and using the resultant dc voltage to bias the component. Such rectifier circuitry could include a voltage multiplier of design different from those illustrated herein. The invention is not limited to the microwave frequency range, but encompasses operation at lower frequencies, including the VHF/UHF range.

I claim:

1. Apparatus for eliminating multipacting in an RF component having at least two electrodes, comprising:

rectifier means, coupled to said RF component, for rectifying the RF potential developed across the electrodes of said component in the absence of multipacting to derive a dc potential therefrom, and means, coupled to said rectifier means, for applying said derived dc potential to said RF component so as to prevent polarity reversal of the electric field between said electrodes.

2. Apparatus according to claim 1 wherein said developed RF potential is floating with respect to ground, and wherein said rectifier means has output terminals across which said derived dc potential is provided, one of said output terminals being grounded.

3. Apparatus according to claim 1 wherein said rectifier means is a voltage doubler circuit comprising:

first and second rectifiers effectively mounted within said RF component, capacitive coupling means, including a capacitor having one element which electrically interconnects the anode terminal of said first rectifier to the cathode terminal of said second rectifier, said one element being situated within said RF component in capacitive coupling proximity to one of said component electrodes, so that said one component electrode also is the second element of said capacitor, the other terminal of one of said rectifiers being dc connected to the other of said component electrodes, the other terminal of the other of said rectifiers being connected in a dc path to said one component electrode, said derived dc potential thereby being provided across said RF component electrodes.

4. An RF resonator having self-biasing to eliminate multipacting, comprising:

a resonator structure including an electrically conductive outer wall electrode and an inner electrode, and means for introducing RF energy into said resonator, rectifier means, situated within said resonator structure, for rectifying a portion of the RF energy present therein, the resultant derived dc potential being applied across said outer wall electrode and said inner electrode, and comprising:

a coupling capacitor including a conductive capacitor element mounted in insulating spaced relationship with said inner electrode, a rectifier having one end mechanically supported by and electrically connected to said capacitor element, a bypass capacitor structure mechanically supported by said outer wall electrode and having a capacitive relationship with said outer wall electrode, said bypass capacitor structure also supporting the other end of said rectifier, and connecting means for electrically connecting the dc output of said rectifier across said outer wall electrode and said inner electrode.

5. A resonator structure according to claim 3 further comprising an RF filter connected in a dc path between said other terminal of said other rectifier and said one component electrode to filter out any RF present at the output of said rectifier means.

6. A resonator according to claim 4 further comprising a second rectifier mechanically and electrically connected between said capacitor element and said outer wall electrode, said first and second rectifiers being electrically connected as a voltage doubler.

* * * * *